US007343749B2

(12) United States Patent
Tsuchikawa et al.

(10) Patent No.: US 7,343,749 B2
(45) Date of Patent: Mar. 18, 2008

(54) METHOD OF OPERATING AUGER ICE-MAKING MACHINE

(75) Inventors: Koji Tsuchikawa, Toyoake (JP); Takashi Hibino, Toyoake (JP); Hideyuki Ikari, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 0 days.

(21) Appl. No.: 11/344,620

(22) Filed: Feb. 1, 2006

(65) Prior Publication Data

US 2006/0150642 A1 Jul. 13, 2006

Related U.S. Application Data

(62) Division of application No. 10/871,787, filed on Jun. 18, 2004, now Pat. No. 7,062,925.

(30) Foreign Application Priority Data

Jun. 24, 2003 (JP) ..... 2003-180227
Jul. 9, 2003 (JP) ..... 2003-272522

(51) Int. Cl.
*F25C 1/14* (2006.01)

(52) U.S. Cl. ..... 62/71; 62/233; 62/354

(58) Field of Classification Search ..... 62/71, 62/137, 233, 354
See application file for complete search history.

(56) References Cited

U.S. PATENT DOCUMENTS 4,622,826 A 11/1986 Tsukiyama et al.
5,901,561 A 5/1999 Allison et al.
6,257,009 B1 * 7/2001 Tsuchikawa ..... 62/233
6,381,975 B1 * 5/2002 Tsuchikawa ..... 62/233

FOREIGN PATENT DOCUMENTS

| | | |
|---|---|---|
| EP | JP 9-210523 | 8/1997 |
| EP | JP 9-269169 | 10/1997 |
| EP | JP 2000-088417 | 3/2000 |
| EP | 1 091 180 | 4/2001 |
| EP | JP 2002-295934 | 10/2002 |

* cited by examiner

*Primary Examiner*—William E. Tapolcai
(74) *Attorney, Agent, or Firm*—William L Androlia; H. Henry Koda

(57) ABSTRACT

A method of operating an auger ice-making machine having a refrigeration casing, an auger screw rotatably disposed inside the casing and feeding, while scraping, the ice frozen on an inner wall surface of the casing, a stocker for storing/retaining the ice fed, the stocker being formed with an ice discharge port of the stocker in order to discharge the ice to an exterior of the machine by being opened, and a stored-ice detector for detecting a high level, and a low level, of a quantity of ice stored within the stocker, wherein: when the stored-ice detector detects the high level, a controller is activated to stop ice-making operation, and when the quantity of ice stored decreases below the low level by a required quantity, the controller restarts the ice-making operation; and when the controller judges, during a stopped state of the ice-making operation, that a block of ice has occurred in the stocker, the controller restarts the ice-making operation, provided that the stored-ice detector has detected the low level.

2 Claims, 7 Drawing Sheets

METHOD OF OPERATING AUGER ICE-MAKING MACHINE

BACKGROUND OF THE INVENTION

1. Field of the Invention

This invention relates to a method of operating an auger ice-making machine, and more particularly, to a method of operating an auger ice-making machine which feeds by means of an auger screw, while scraping, the ice frozen on an inner wall surface of a refrigeration casing, compresses the frozen ice by means of a push head, and stores in a stocker the compressed ice obtained.

2. Description of the Related Art

In the kitchens of coffee shops, restaurants, and the like, ice-making machines for manufacturing blocks of ice of required shapes have been conveniently used for a long time, and these types of machines include an auger type of ice-making machine used for continuously manufacturing blocks of ice in the form of small pieces such as ice chips or ice flakes. In the auger ice-making machine, when ice-making operation is started with ice-making water stored within a cylindrical refrigeration casing at a required level, the casing is forcedly cooled by a refrigerant circulating through an evaporation pipe connected to a refrigerating system. Hence, the ice-making water starts freezing progressively from an inner wall surface of the casing, and thus thin ice of a laminar form is formed. The refrigeration casing has an auger screw inserted thereinto, and when the auger screw is rotationally driven by an auger motor, the thin ice frozen on the inner wall surface of the casing is fed upward by the auger screw while being scraped into a flake form thereby. While passing through a push head disposed in an upper inner section of the refrigeration casing, the flake-form ice fed by the auger screw is compressed, whereby moisture is removed from the ice and compressed ice (ice) is manufactured. The compressed ice that has thus been obtained is discharged and stored in a stocker.

The foregoing auger ice-making machine has, inside the above stocker, stored-ice detection means including a reed switch capable of detecting a storage level of compressed ice, and is adapted to store a required quantity of compressed ice in the stocker at all times. This is accomplished by conducting control so that when the switch turns on to indicate that the detection means has detected a full state (high level) of the compressed ice in the stocker, ice-making operation is stopped, and so that when the switch turns off to indicate that the detection means has detected a decrease in the quantity of compressed ice within the stocker to a required level (low level) due to ice consumption (discharge from the stocker), the ice-making operation is restarted.

However, the differential between the high level and low level detected by the stored-ice detection means is limited to a small value, and after detection of the high level (i.e., the stop of the ice-making operation), the low level resulting from slight melting of the compressed ice or from a small quantity of discharge thereof is detected prior to the restart of the ice-making operation. After this, since a small quantity of compressed ice is only added during the ice-making operation, a full state (high level) is detected soon and the ice-making operation stops. In this case, compressed ice in an incompletely solidified condition is stored in the stocker initially during the restart of the ice-making operation. Accordingly, if the start and stop of the operation are repeated within a short time period by such control as described above, the quantity of compressed ice in an incompletely solidified condition (so-called scrap ice) in the stocker progressively increases. Since such scrap ice is very soft, it sticks to the inner wall surface of the stocker in the form of a donut, then changing into a block of ice, thus impeding the discharge of compressed ice. In addition, a full-state detection failure could result if the block of ice grows to a level at which the stored-ice detection means is disposed. Therefore, if ice-making operation is continued in that state or the machine remains exposed to a cryogenic atmosphere, the entire stocker encounters the serious trouble of freezing. Furthermore, not only the compressed ice could not only become a mass too large to be discharged from the stocker, but also is indicated the likelihood of damage being caused to the auger motor and other ice-making mechanical sections by significant loading.

For these reasons, Japanese Unexamined Patent Publication No. 2001-141344, for instance, proposes a technology for preventing the above-mentioned repetition of start/stop of ice-making operation within a short time period and hence the occurrence of various trouble, associated with the above-mentioned increase in the quantity of scrap ice, by setting the restarting timing of the operation, based on combined use of the storage level of the compressed ice inside the stocker and other parameters.

According to the technology disclosed in the above Patent Publication, the machine is constructed so as to start counting a previously set delay time (one of the other parameters mentioned above) from the time that the stored-ice detection means detects that the quantity of compressed ice in the stocker has been reduced to a low level by consumption, and restart ice-making operation after the delay time has elapsed. In this case, if the stored-ice detection means is maintained in a full-stocker-state (high-level) detection condition by the occurrence of a block of ice in the stocker, even when the compressed ice is discharged from the machine or melts during that time, counting of the delay time is not started since the stored-ice detection means does not detect a low level. Therefore, the quantity of compressed ice is likely to have significantly decreased by the time the block of ice melts and collapses to cause the stored-ice detection means to detect a low level. Consequently, a shortage of ice could occur since the stocker will have become empty by the time a subsequent delay time elapses.

In addition, although the stocker of the foregoing ice-making machine is heat-insulated, melting of the compressed ice in the stocker with time reduces the storage level, and even if the compressed ice is not discharged, the low level may be detected. Furthermore, the speed at which the ice melts is affected by the ambient temperature of the location at which the ice-making machine is installed, and the melting speed of the ice greatly differs between, for example, the wintertime and the summertime. In this case, for example, if the above-mentioned delay time is set to take a small value fit for the time of the year when ice rapidly melts, such as in the summer, the effect of providing the delay time is not obtainable at the time of the year when ice melts slowly, as in the winter. This is because, despite only a slight quantity of compressed ice decreasing, ice-making operation is restarted and such scrap ice as mentioned above increases. Conversely, it is indicated the problem that if the above-mentioned delay time is set to take a large value fit for the time of the year when ice slowly melts, such as in the winter, the stocker runs out of compressed ice at the time of the year when ice melts rapidly, as in the summer. It becomes necessary for a user, therefore, to perform troublesome and complex operations to optimize the setting of the above delay time according to the particular ambient temperature. If stored-ice detection means for detecting a high level and stored-ice detection means for detecting a low level are disposed spacedly in a vertical direction and the differential between both levels is set to take a large value, repetition of the start/stop of operation within a short time period can be prevented without adjusting the delay time. In this case, however, the number of stored-ice detection means increases, thereby increasing costs, disadvantageously.

SUMMARY OF THE INVENTION

A controller conducts control, provided that when stored-ice detection means detects a high level (H), the controller stops ice-making operation, and that when actual ice decrement quantity G has exceeded a previously set initial operating quantity of ice, C, the controller restarts the ice-making operation. In addition, when a total ice discharge time of T6 by an ice discharge timer for counting the time during which compressed ice is discharged from an ice discharge port in a stopped state of the ice-making operation increases above a previously-set required time of T7, if the stored-ice detection means detects high level H, the controller judges that a block of ice is occurring. Subsequently, when the stored-ice detection means detects a low level (L), the controller restarts the ice-making operation, irrespective of the value of actual ice decrement quantity G.

When the stored-ice detection means detects high level H, the controller stops the ice-making operation. A unit quantity of molten ice, F, is calculated from a reference time count of T1 up to detection of low level L by the stored-ice detection means, and from a reference quantity of ice storage, D. A total quantity of molten ice, B, is calculated from the unit quantity of molten ice, F, and an actual time count of T3. The controller restarts the ice-making operation, provided that actual ice decrement quantity G that is a sum of the total quantity of molten ice, B, and a total quantity of ice discharge, A, has exceeded the previously set initial operating quantity of ice, C.

DETAILED DESCRIPTION OF THE PREFERRED EMBODIMENTS

Next, methods of operating an auger ice-making machine according to preferred embodiments of the present invention are described below referring to the accompanying drawings.

Figure 1:
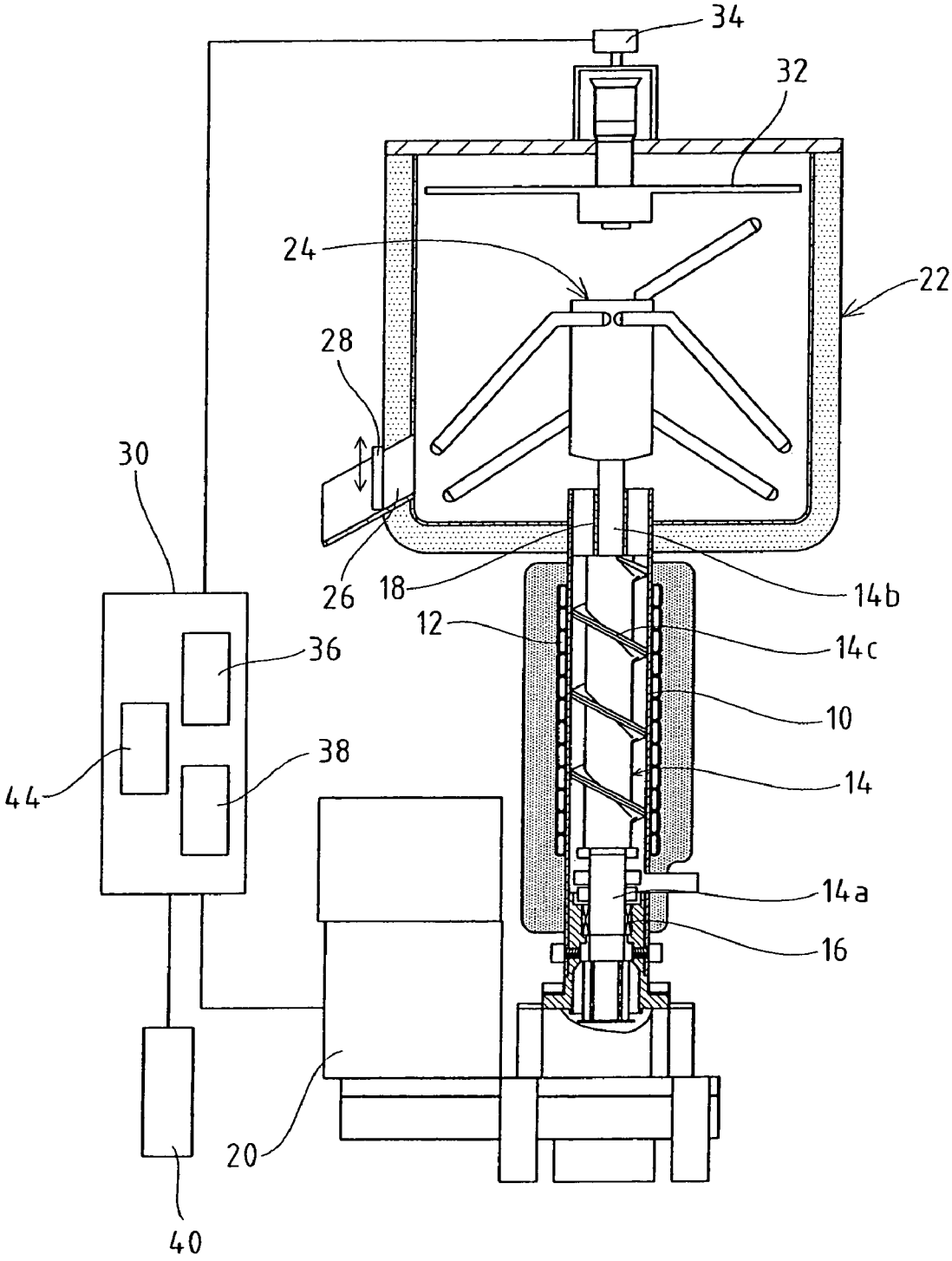
FIG. 1 is a schematic diagram showing an auger ice-making machine to which is applied an operating method according to a first embodiment of the present invention.

FIG. 1 shows a schematic configuration of an auger ice-making machine to which is applied an operating method according to a first embodiment of the present invention. In FIG. 1, the auger ice-making machine has, on an outer surface of a cylindrical refrigeration casing 10, an evaporation pipe (evaporation section) 12 communicating with a refrigerating system is tightly wound, and the machine is adapted to forcibly cool the refrigeration casing 10 by circulating a refrigerant through the evaporation pipe 12 when ice-making operation is started. In addition, the refrigeration casing 10 is adapted so that when ice-making water is supplied from an ice-making water tank (not shown) at a required level and ice-making operation is started, the refrigeration casing 10 is forcibly cooled. Hence, the ice-making water starts freezing gradually from an inner wall surface of the casing, and thus thin ice of a laminar form is formed.

Inside the refrigeration casing 10, an auger screw 14 is inserted, a lower shaft 14*a* thereof is rotatably supported by a lower bearing 16 disposed at a lower section of the refrigeration casing 10, and an upper shaft 14*b* is rotatably supported by a push head 18 disposed in an upper inner section of the refrigeration casing 10. The auger screw 14 is rotationally driven by an auger motor 20 disposed at a lower section of the ice-making machine. In addition, a scraping cutter blade 14*c* with an outside diameter slightly smaller than an inside diameter of the refrigeration casing 10 is helically formed on the auger screw 14, and the thin ice frozen on the inner wall surface of the casing 10 is fed upward while being scraped by the scraping cutter blade 14*c* of the auger screw 14 rotationally driven by the auger motor 20.

During its passage through the push head 18, the flake-like ice fed upward by the auger screw 14 while being scraped is then compressed, whereby moisture is removed from the ice and compressed ice is manufactured. The compressed ice that has thus been obtained is discharged and stored in a stocker 22 disposed at an upper section of the refrigeration casing 10.

Inside the stocker 22, a stirrer 24 coupled with the auger screw 14 is rotatably disposed and is adapted to rotate with the auger screw to stir the compressed ice stored within the stocker 22. The stocker 22 also internally has an ice discharge port 26, which is opened and closed by a shutter 28. When an ice discharge button not shown is pressed (turned on), the shutter 26 is actuated by a controller 30 (described later). Thus, the ice discharge port 26 is opened, the stirrer 24 rotates, and the compressed ice inside the stocker 22 is discharged from the ice discharge port 26 to an exterior of the machine.

The above-mentioned auger ice-making machine has a controller 30 as control means of undertaking total electrical control of the machine, and the machine uses the controller 30 to control the operation of the ice-making mechanism constituted by a compressor, a fan motor, an auger motor 20, and other elements. The controller 30 is also adapted not only to conduct opening/closing control of the shutter 28, but also to monitor a quantity of ice discharged from the ice discharge port 26 (i.e., a total quantity of ice discharge, A), on the basis of an open-state duration of the shutter 28. In addition, as described later, the controller 30 is set to monitor a quantity of compressed ice melting inside the stocker 22, as a quantity of molten ice (a total quantity of molten ice, B), and conducts operation control of the ice-making machine, based on the total quantity of ice discharge, A, and the total quantity of molten ice, B.

The stocker 22 also internally has, at its ceiling, a float plate 32 disposed in a vertically movable condition, and the float plate 32 is adapted to move vertically according to a quantity of compressed ice discharged from the push head 18 into the stocker 22 (i.e., according to a particular storage level of the ice). In addition, the stocker 22 has a stored-ice detector 34 for detecting low level L and high level H as storage levels of the ice within the stocker by detecting vertical movements of the float plate 32. That is to say, when the compressed ice is discharged from the push head 18 into the stocker 22, the storage level increases, and then when the float plate 32 is pushed upward by the compressed ice and reaches high level H related to a previously set full state, the stored-ice detector 34 detects high level H and the resulting high-level signal is input to the controller 30. When the compressed ice is reduced in storage level by being discharged from the stocker 22 to the machine exterior or by melting and the float plate 32 thus moves downward to previously set low level L, the stored-ice detector 34 detects low level L and the resulting low-level signal is input to the controller 30. During the time from completion of detection of high level H to detection of low level L, the stored-ice detector 34 inputs the above-mentioned high-level signal to the controller 30. For example, a reed switch as the stored-ice detector 34, turns on when it detects high level H, and turns off when it detects low level L.

When the high-level signal is input from the stored-ice detector 34, the controller 30 stops the operation (ice-making operation) of the ice-making machine by turning off the auger motor, the compressor, and the fan motor. After input of the high-level signal, the controller 30 conducts control to restart the ice-making machine, provided that actual ice decrement quantity G that is a sum of the total quantity of molten ice, B, and the total quantity of ice discharge, A, has exceeded a previously set initial operating quantity of ice, C. In addition, the controller 30 has a measuring timer 36 that starts counting when the stored-ice detector 34 detects high level H, and an accumulative timer 38 that accumulates an open-state duration of the ice discharge port 26 (i.e., an ice discharge time). The stored-ice detector 34 calculates the total quantity of molten ice, B, and the total quantity of ice discharge, A, from a time count of the measuring timer 36 and an accumulative time count of the accumulative timer 38. Incidentally, the accumulative timer 38 is set so that it accumulatively counts a time (seconds) for which a user presses an ice discharge button.

To the controller 30 are input beforehand a reference quantity of ice storage, D (the quantity of compressed ice stored during the time from detection of low level L by the stored-ice detector 34 to detection of high level H thereby), and a unit quantity of ice discharge, E (the quantity of compressed ice discharged from the ice discharge port 26 per unit time). The reference quantity of ice storage, D, and the unit quantity of ice discharge, E, are calculated from the test results obtained beforehand. The controller 30 then calculates a unit quantity of molten ice, F (the quantity of ice melting per unit time), from the reference quantity of ice storage, D, and a reference time count of T1 by the measuring timer 36 from the stop of the ice-making operation to detection of low level L by the stored-ice detector 34. In addition, the controller 30 is adapted to calculate the total quantity of molten ice, B, from an actual time count of T3 which indicates the time from the operation stop based on the measuring timer 36, and the unit quantity of molten ice, F. Furthermore, the controller 30 is adapted to calculate the total quantity of ice discharge, A, from the unit quantity of ice discharge, E, and an accumulative open-state duration count T2 of the ice discharge port 26 by the accumulative timer 38. As described above, the controller 30 is set so that, provided that actual ice decrement quantity G (i.e., the sum of the total quantity of molten ice, B, and the total quantity of ice discharge, A) has exceeded the previously set initial operating quantity of ice, C, the controller provides control to restart the ice-making machine.

The initial operating quantity of ice, C, serves as a criterion for judging how far the quantity of compressed ice needs to go down before ice-making operation can be restarted from its stoppage due to detection of high level H by the stored-ice detector 34. The initial operating quantity of ice, C, is set from a capacity of the stocker 22 and other parameters such as a sufficient operating time required for solid compressed ice to be manufactured after the restart of the ice-making operation, and the setting is then input to the controller 30 beforehand. Also, the initial operating quantity of ice, C, is set to take a greater value than the reference quantity of ice storage, D, such that the ice-making operation is restarted when the ice storage level (quantity of ice storage) in the stocker 22 decreases by a required value below low level L.

When the unit quantity of molten ice, F, is to be calculated, if compressed ice is discharged from the ice discharge port 26 by a press of the ice discharge button during the time from the stop of the ice-making operation by the detection of high level H by the stored-ice detector 34 to the detection of low level L thereby, a correct value cannot be obtained by calculating the unit quantity of molten ice, F, by use of the reference quantity of ice storage, D. When calculating the unit quantity of molten ice, F, therefore, the controller 30 uses the value obtained as a new reference quantity of ice storage, D1, by subtracting the unit quantity of ice discharge, E, and the open-state duration count by the accumulative timer 38, from the reference quantity of ice storage, D.

Furthermore, before actual ice decrement quantity G exceeds the initial operating quantity of ice, C, when actual time count T3 by the measuring timer 36 reaches or exceeds a previously set maximum time of T4, the controller 30 restarts the ice-making operation in preference to the relationship between actual ice decrement quantity G and the initial operating quantity of ice, C. Besides, the controller 30 maintains the stopped state of the ice-making operation until actual time count T3 by the measuring timer 36 has reached or exceeded a previously set minimum time of T5.

The controller 30 has an alarm lamp 40 connected as alarm means, and is adapted so that even after the total quantity of ice discharge, A, has exceeded the initial operating quantity of ice, C, if the stored-ice detector 34 does not detect low level L, the controller 30 activates the alarm lamp 40 to alarm the user of the fact that an abnormality is occurring.

At this time, if the block of ice that has occurred in the stocker 22 makes the float plate 32 unable to move downward from high level H and thus the stored-ice detector 34 is maintained in a detection state of high level H, the above-described problem arises since the quantity of compressed ice is likely to have decreased significantly by the time the stored-ice detector 34 detects low level L as a result of, as described above, the block of ice melting and collapsing. In the auger ice-making machine according to the present embodiment, therefore, the controller 30 has an ice discharge timer 44 that accumulatively counts the time (seconds) during which the user is pressing the ice discharge button. When a total ice discharge time of T6 counted by the ice discharge timer 44 becomes equal to or exceeds a previously-set required time of T7, if the stored-ice detector 34 detects high level H, the controller 30 judges that a block of ice is occurring in the stocker, and consequently conducts abnormal-operation control.

The required time of T7 is set to ensure that under the relationship between the reference quantity of ice storage, D, of compressed ice during the time from high level H and low level L, and the unit quantity of ice discharge, E (the quantity of ice discharged from the ice discharge port 26 per unit time), the quantity of ice discharged during the required time of T7 is greater than the reference quantity of ice storage, D. In other words, despite the fact that after the stored-ice detector 34 has detected high level H, if the total ice discharge time of T6 is equal to or exceeds the required time of T7, the stored-ice detector 34 must have, of course, detected high level H, if high level H still remains detected, this means that the float plate 32 is judged unable to move below high level H because of the block of ice being present.

Next, the operation of the method of operating an auger ice-making machine according to the above first embodiment is described below with reference to the flowcharts of FIGS. 2 to 4.

Figure 2:
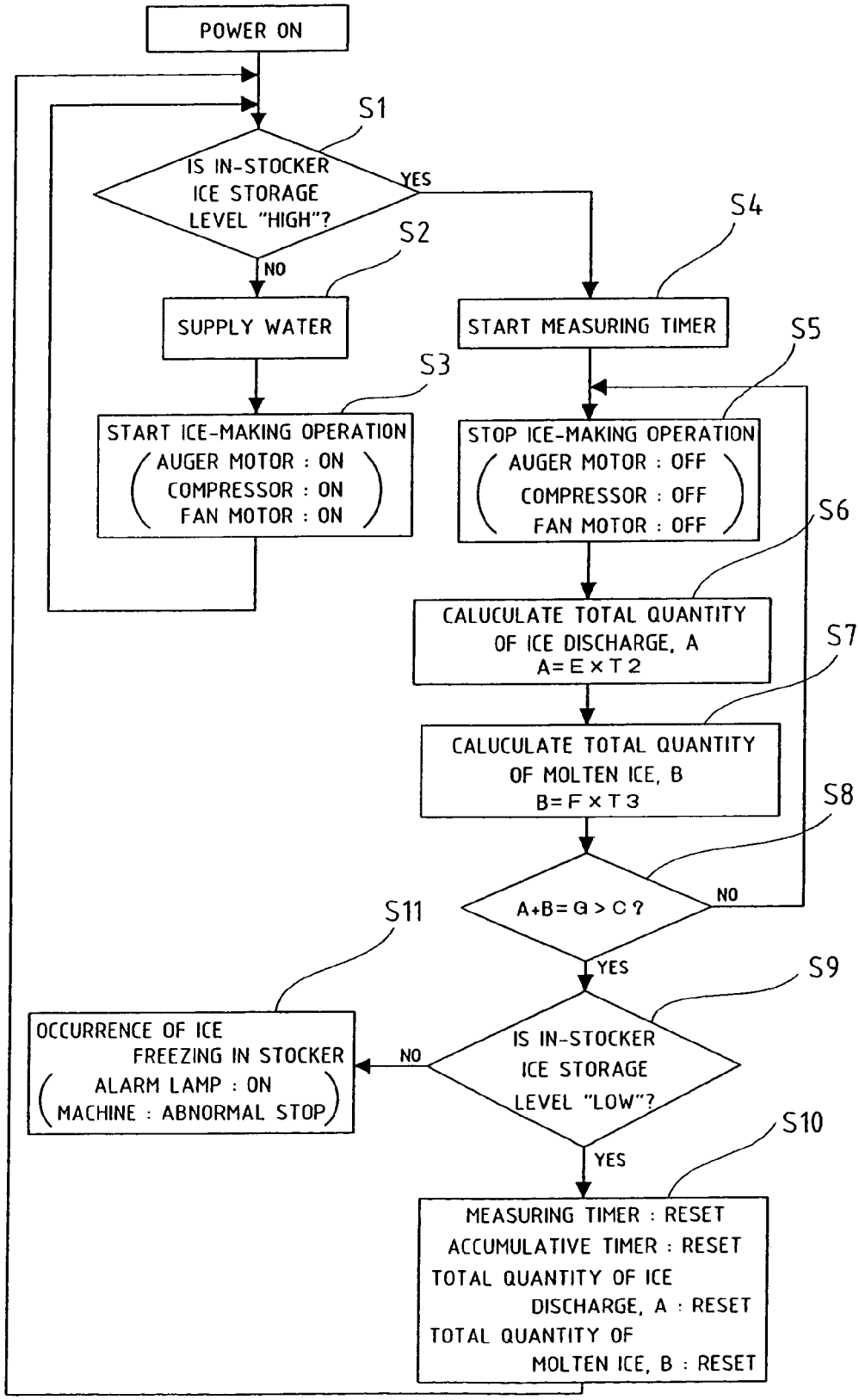
FIG. 2 is a main flowchart applied when an auger ice-making machine is operated using the operating methods according to the first embodiment and a second embodiment.

As shown in FIG. 2, when a power supply switch for starting the above-mentioned auger ice-making machine is turned on, whether the storage level of compressed ice in the stocker 22 is "high level H" is confirmed in step S1. If judgment results are negative (NO), water is supplied to the refrigeration casing 10 in step S2 and then ice-making operation is started in step S3. That is, the auger motor 20 and the compressor, fan motor, and other elements constituting the ice-making mechanism are started.

When ice-making operation is started, the refrigeration casing 10 is forcedly cooled by exchanging heat with the refrigerant circulated through the evaporation pipe 12. Consequently, the ice-making water supplied from an ice-making water tank (not shown) to the refrigeration casing 10 starts freezing gradually from the inner wall surface of the casing, and thin ice of a laminar form is formed. Next, the thin ice is fed upward while being scraped by a scraping cutter blade 14*c* of the auger screw 14 rotationally driven by the auger motor 20. The flake-like ice fed upward by the auger screw 14 is then compressed while being passed through the push head 18 disposed in an upper internal section of the refrigeration casing 10, and the compressed ice that has thus been obtained is discharged and stored into the stocker 22.

After the storage level of the compressed ice in the stocker 22 has increased and the float plate 32 has been pushed upward to make the stored-ice detector 34 detect high level H, YES is presented as positive confirmation results in step S1, the process proceeds to step S4 to make the measuring timer 36 start counting, and the ice-making operation is stopped in step S5. That is, the auger motor 20, the compressor, the fan motor, and other ice-making mechanical sections are stopped.

During the stop of the ice-making operation, a press (turn-on) of the ice discharge button by the user discharges the compressed ice from the stocker 22. More specifically, when the ice discharge button is pressed, the shutter 28 is actuated by the controller 30 to open the ice discharge port 26 and thus to discharge the compressed ice therefrom. At this time, the auger motor 20 is rotationally driven to rotate the stirrer 24 and accelerate the discharge of the compressed ice, and the time during which the ice discharge port 26 is open is counted by the accumulative timer 38. The time during which the ice discharge port 26 is open during a pressed (turned-on) state of the ice discharge button is also counted by the ice discharger timer 44. During the stop of the ice-making operation, the compressed ice inside the stocker 22 naturally melts stepwise by being affected by the ambient temperature. In other words, although the quantity of compressed ice in the stocker 22 is maintained at "high level H" during the stopped state of the ice-making operation, the discharge of the compressed ice by the user and natural melting of the compressed ice with time lead to gradual decreases in the storage level.

In step S6 of FIG. 2, the quantity of compressed ice discharged from the stocker 22 to the machine exterior is calculated. That is, the total quantity of ice discharge, A, is calculated from the value previously input to the controller 30, i.e., the unit quantity of ice discharge, E (the quantity of ice discharged from the ice discharge port 26 per unit time), and accumulative open-state duration count T2 of the ice discharge port 26 by the accumulative timer 38.

In next step S7, the total quantity of compressed ice naturally melting in the stocker 22 is calculated as the total quantity of molten ice, B. Prior to the calculation of the total quantity of molten ice, B, when high level H is detected by the stored-ice detector 34, the controller 30 starts calculating the unit quantity of molten ice, F. That is, as shown in the flowchart of FIG. 3, the previously input reference quantity of ice storage, D, is set in step S21 and then a new reference quantity of ice storage, D1, is calculated in step S22 by subtracting, from the reference quantity of ice storage, D, the total quantity of ice discharge, A, that was obtained in step S6 of FIG. 2. If no compressed ice is discharged in the stopped state of the ice-making operation, the new reference quantity of ice storage, D1, becomes the same as the reference quantity of ice storage, D.

Figure 3:
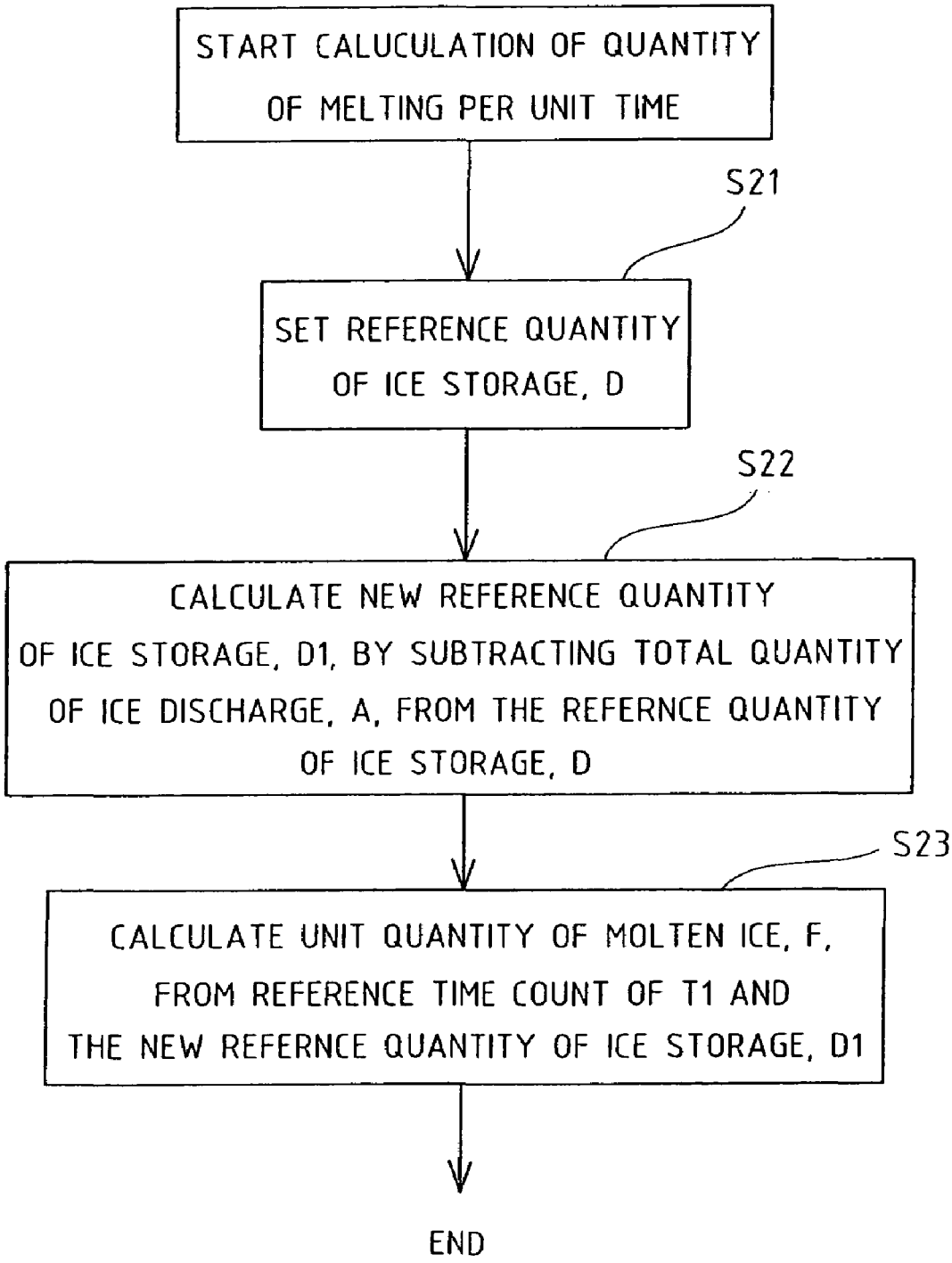
FIG. 3 is a flowchart for calculating a unit quantity of ice melting ice per unit time during the operations using the operating methods according to the first embodiment and the second embodiment.
Figure 4:
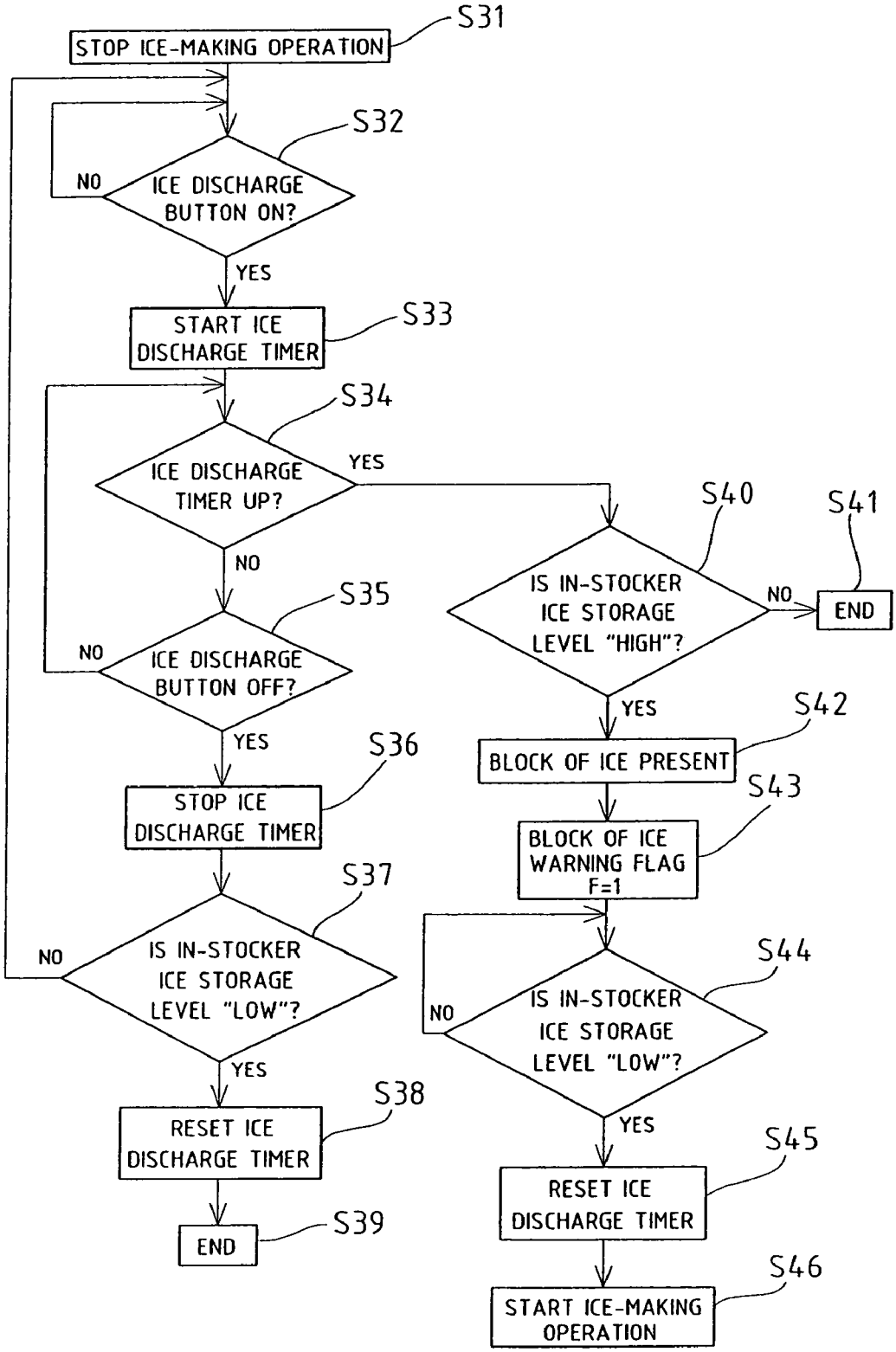
FIG. 4 is a flowchart for coping with the occurrence of a block of ice during operations using the operating method according to the first embodiment.

When the stored-ice detector 34 detects low level L, the unit quantity of molten ice, F, is calculated in step S23 of FIG. 3 from reference time count T1 that is a time counted by the measuring timer 36 up to the detection of low level L, and either the new reference quantity of ice storage, D1, calculated in step S22, or the previously set reference quantity of ice storage, D. The unit quantity of molten ice, F, is commensurate with the ambient temperature at which the auger ice-making machine is installed. The unit quantity of molten ice, F, therefore, takes a large value when the ambient temperature is high as in the summertime, and takes a small value when the ambient temperature is low as in the wintertime.

In step S7 of FIG. 2, the total quantity of molten ice, B, i.e., the total quantity of melting of compressed ice up to the present, is calculated from the unit quantity of molten ice, F, calculated in the manner mentioned above, and actual time count T3 that is the current time count by the measuring timer 36.

In next step S8, it is confirmed whether actual ice decrement quantity G that is the sum of the total quantity of ice discharge, A, and the total quantity of molten ice, B, is in excess of the initial operating quantity of ice, C, previously input to the controller 30. If the results are NO, the process returns to step S5 in order to maintain the stopped status of the ice-making operation. This means that until actual ice decrement quantity G has exceeded the initial operating quantity of ice, C, even when the stored-ice detector 34 detects low level L, the stopped status of the ice-making operation is maintained. Accordingly, the small differential of the stored-ice detector 34 makes it possible to prevent the repetition of operation starting/stopping within a short time period and prevent the occurrence of scrap ice, and reduces a load on the ice-making mechanism.

If the confirmation results in step S8 are YES (actual ice decrement quantity G is in excess of the initial operating quantity of ice, C), the process proceeds to next step S9, in which it is then confirmed whether the storage level of the compressed ice in the stocker 22 is "low level L".

If the confirmation results in step S9 are YES (the storage level of the compressed ice is "low level L"), the measuring timer 36, the accumulative timer 38, the total quantity of ice discharge, A, and the total quantity of molten ice, B, are all reset in step S10. The process then returns to the first step S1 in order to repeat the flow described above. That is, when actual ice decrement quantity G exceeds the initial operating quantity of ice, C, if the storage level of the compressed ice in the stocker 22 is below "low level L", the controller 30 starts (restarts) the ice-making operation. Since the unit quantity of molten ice, F, used as the base for calculating the total quantity of molten ice, B, is, as mentioned above, commensurate with the ambient temperature at which the auger ice-making machine is installed, ice-making operation can always be started at a stable storage/retention level, regardless of changes in the ambient temperature.

If the results in step S9 are NO, in step S11, an alarm device, such as the alarm lamp 40, is activated to indicate the occurrence of an abnormality, and the machine itself is brought to an abnormal stop. In other words, if, despite the fact that actual ice decrement quantity G has exceeded the initial operating quantity of ice, C, the stored-ice detector 34 does not detect low level L, the controller 30 judges that arching due to freezing of the compressed ice within the stocker 22 is causing an abnormality such as a downward movement failure in the float plate 32. Resultingly, the controller 30 activates the alarm lamp 40 or the like. In the state where low level L is not detected by the stored-ice detector 34, since the unit quantity of molten ice, F, is not calculated, actual ice decrement quantity G at this time is composed only of the value of the total quantity of ice discharge, A.

In the controller 30, before actual ice decrement quantity G and the initial operating quantity of ice, C, are compared in accordance with the flowchart of FIG. 2, process steps different from those of FIG. 2 are performed to respond to the occurrence of a block of ice. That is, when the stored-ice detector 34 detects high level H and ice-making operation is therefore stopped in step S31 of FIG. 4, step 32 is conducted to confirm whether the ice discharge button has been turned on (the discharge of the compressed ice has been started), and if NO is presented, step 32 is repeated. If the confirmation results in step S32 are YES, since this means that ice discharge button has been turned on to start the discharge of the compressed ice, the process proceeds to step S33 in order to start the counting operation of the ice discharge timer 44.

Next, whether the total ice discharge time of T6 counted by the ice discharge timer 44 has reached the required time of T7 is confirmed in step S34. If the results are NO, the process proceeds to step S35 in order to confirm whether the ice discharge button has been turned off, i.e., whether the discharge of the compressed ice has been stopped. If the confirmation results in step S35 are NO, the process returns to step S34. If the confirmation results in step S35 are YES (the ice discharge button has been turned off to stop the discharge of the compressed ice), the process proceeds to step S36 in order to stop the counting operation of the ice discharge timer 44.

Following this, step S37 is performed to confirm whether the storage level of the compressed ice in the stocker 22 is "low level L", and if the results are NO, the process returns to step S32 in order to repeat the above flow. If the confirmation results in step S37 are YES, the process proceeds to step S38 in order to reset the ice discharge timer 44, and the process is terminated in step S39. That is, if the storage level of the compressed ice in the stocker 22 is below "low level L" with the total ice discharge time of T6 of the ice discharge timer 44 not reaching the required time of T7 (i.e., with the confirmation results in step S34 being NO), the controller 30 judges that the float plate 32 is properly moving downward with decreases in the quantity of compressed ice. The controller 30 judges, therefore, that a block of ice is not occurring in the stocker 22. If NO is presented in step S37, the process returns to step S32 in order to repeat the above flow.

In contrast, if YES is presented in step S34, the process skips to step S40 in order to confirm whether the storage level of the compressed ice in the stocker 22 is "high level H". If the confirmation results in step S40 are NO, this indicates that the storage level is low L, and in this case, the controller 30 also judges that a block of ice is not occurring in the stocker 22, and the process proceeds to step S41 to terminate the control.

However, if the confirmation results in step S40 are YES, the process proceeds to step S42, in which a block of ice is then judged present. That is, if the total ice discharge time of T6 is equal to or in excess of the required time of T7, this means that a greater quantity of compressed ice than the reference quantity of ice storage, D, is being discharged to the machine exterior. Therefore, the fact that, at this time, the stocker 22 still remains at high ice storage level H indicates that a state in which the downward movement of the float plate 32 is being obstructed by a block of ice is judged to be occurring. In this case, the process then proceeds to step S43 and sets up a block-of-ice warning flag (F=1).

Next, whether the storage level of the compressed ice in the stocker 22 is "low level L" is confirmed in step S44 and if the results are NO, step S44 is repeated. If the confirmation results in step S44 are YES, the ice discharge timer 44 is reset in step S45 and then in step S46, ice-making operation is started (restarted). This means that after the controller 30 has judged a block of ice to be present, when the stored-ice detector 34 detects low level L, the ice-making operation is immediately started without a comparison being conducted between actual ice decrement quantity G and the initial operating quantity of ice, C. Hence, when the block of ice melts and collapses and the stored-ice detector 34 detects low level L, the ice-making operation can be started, and until actual ice decrement quantity G has exceeded the initial operating quantity of ice, C, the ice-making operation is maintained in a stopped state, whereby a shortage of the compressed ice can be prevented.

Before actual ice decrement quantity G exceeds the initial operating quantity of ice, C, if an actual time count of T3 by the measuring timer 36 reaches or exceeds a previously set maximum time of T4 (for example, 12 hours), the controller 30 starts the ice-making operation. If the ambient temperature is low and there persists a state in which almost no compressed ice inside the stocker 22 melts and neither is the compressed ice discharged, since arching or blocking due to freezing of the compressed ice inside the stocker 22 is prone to occur, the ice-making operation is started when the maximum time setting of T4 is reached. Consequently, the compressed ice inside the stocker 22 can be stirred by rotating the stirrer 24 to prevent the occurrence of arching or blocking.

At this time, after the stored-ice detector 34 has detected high level H, if the power supply switch is turned off for some reason and then the power supply switch is turned on again, although high level H remains detected by the stored-ice detector 34, it cannot be seen at what position between high level H and low level L the actual ice storage level is. However, the controller 30 judges that the ice storage level in the stocker 22 is high level H, and conducts processing based on the flowchart of FIG. 2. In this case, an appropriate unit quantity of molten ice, F, or actual ice decrement quantity G cannot be calculated. The controller 30, therefore, conducts control for the stopped state of the ice-making operation to be maintained until the actual time count of T3 by the measuring timer 36 has exceeded a previously set minimum time of T5 (for example, 3 hours). It is thus possible to prevent ice-making operation from being started within a short time on the basis of an inappropriate unit quantity of molten ice, F, or actual ice decrement quantity G.

According to the first embodiment described above, it is possible to set appropriate startup timing of ice-making operation automatically according to a particular ambient temperature without adding a new stored-ice detection device. It is also possible to reduce costs, and there is no need to change a delay time or to perform other such troublesome and complex operations as required in the conventional technology. In addition, the occurrence of scrap ice is prevented, ice quality improves as a result, and arching due to the occurrence of scrap ice is suppressed. Furthermore, since the frequency of starting/stopping the ice-making machine decreases, a load on the ice-making mechanism is relieved and longer-life operation is achieved, which, in turn, reduces startup energy consumption and hence saves energy. Besides, even if blocks of ice occur in the stocker 22, appropriate response is possible and compressed ice can be prevented from lacking.

While a special ice discharge timer for block-of-ice countermeasures is provided in the first embodiment, the above-mentioned accumulative timer can also be used as the ice discharge timer. In addition, in the first embodiment, although ice-making operation is controlled so as to be started when an actual decrement of ice and an initial operating quantity of ice are compared and the quantity of ice stored is smaller than its low level by a required quantity, the ice-making operation may be controlled so as to be started when the setting of a delay timer which starts counting at the time of low-level detection by the above-mentioned stored-ice detector is reached to indicate that the quantity of ice stored has decreased below its low level by a required quantity.

In the first embodiment, although it is judged that when the total ice discharge time of the ice discharged from the ice discharge port is in excess of a required time, if the stored-ice detector detects a high level, a block of ice is judged to have occurred, no compressed ice is likely to be discharged during a stopped state of ice-making operation. The controller may therefore be programmed so that a time at which a greater quantity of compressed ice than a reference quantity of ice storage is estimated to melt is taken as a required time, and that when a timer that starts counting from the time of stoppage of ice-making operation counts the required time, if the stored-ice detector detects a high level, a block of ice is judged to have occurred.

Figure 5:
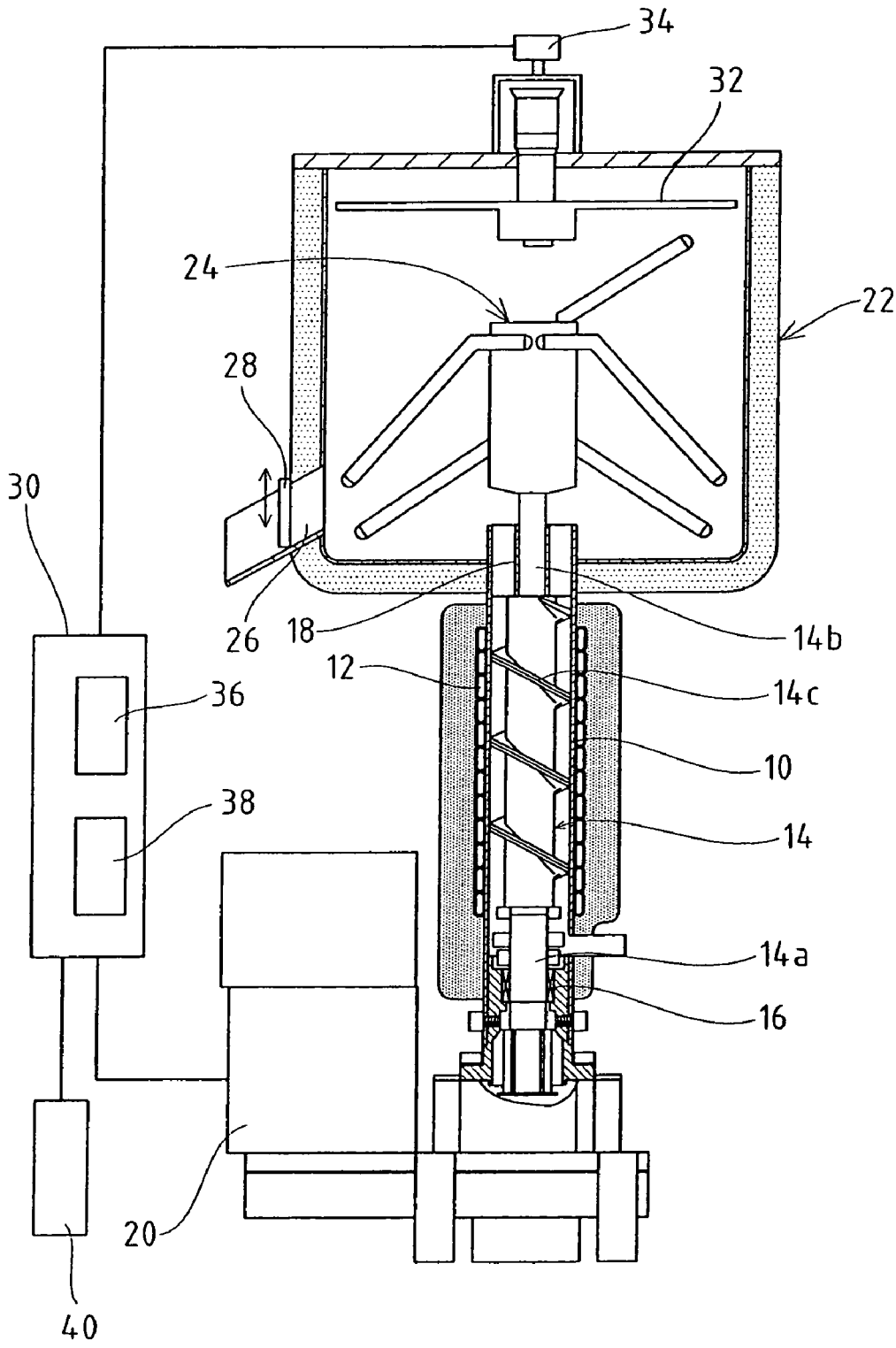
FIG. 5 is a schematic diagram showing an auger ice-making machine to which is applied the operating method according to the second embodiment of the present invention.

Next, a second embodiment of a method of operating an auger ice-making machine according to the present invention is described below referring to the accompanying drawings. FIG. 5 shows a schematic configuration of an auger ice-making machine to which the operating method according to the second embodiment is applied, and the basic configuration of the machine is the same as that described in FIG. 1. Basic operation flow is also the same as that described earlier in relation to FIGS. 2 and 3. The unit quantity of molten ice, F, is likely to be incalculable if the quantity of ice discharge that is the quantity of compressed ice discharged from the ice discharge port 26 by a press of the above-mentioned ice discharge button following the stop of ice-making operation exceeds the above-mentioned reference quantity of ice storage, D. If this condition is actually established, therefore, the controller 30 is constructed so that a maximum value previously set and input to the controller 30 (for example, a value assuming an ambient temperature of 37° C.) is set as the unit quantity of molten ice, F. In addition, if the total quantity of ice discharge, A, that was calculated in above-mentioned step S6 is in excess of the above-mentioned reference quantity of ice storage, D, the maximum value previously set and input to the controller 30 is used as the unit quantity of molten ice, F.

Figure 6:
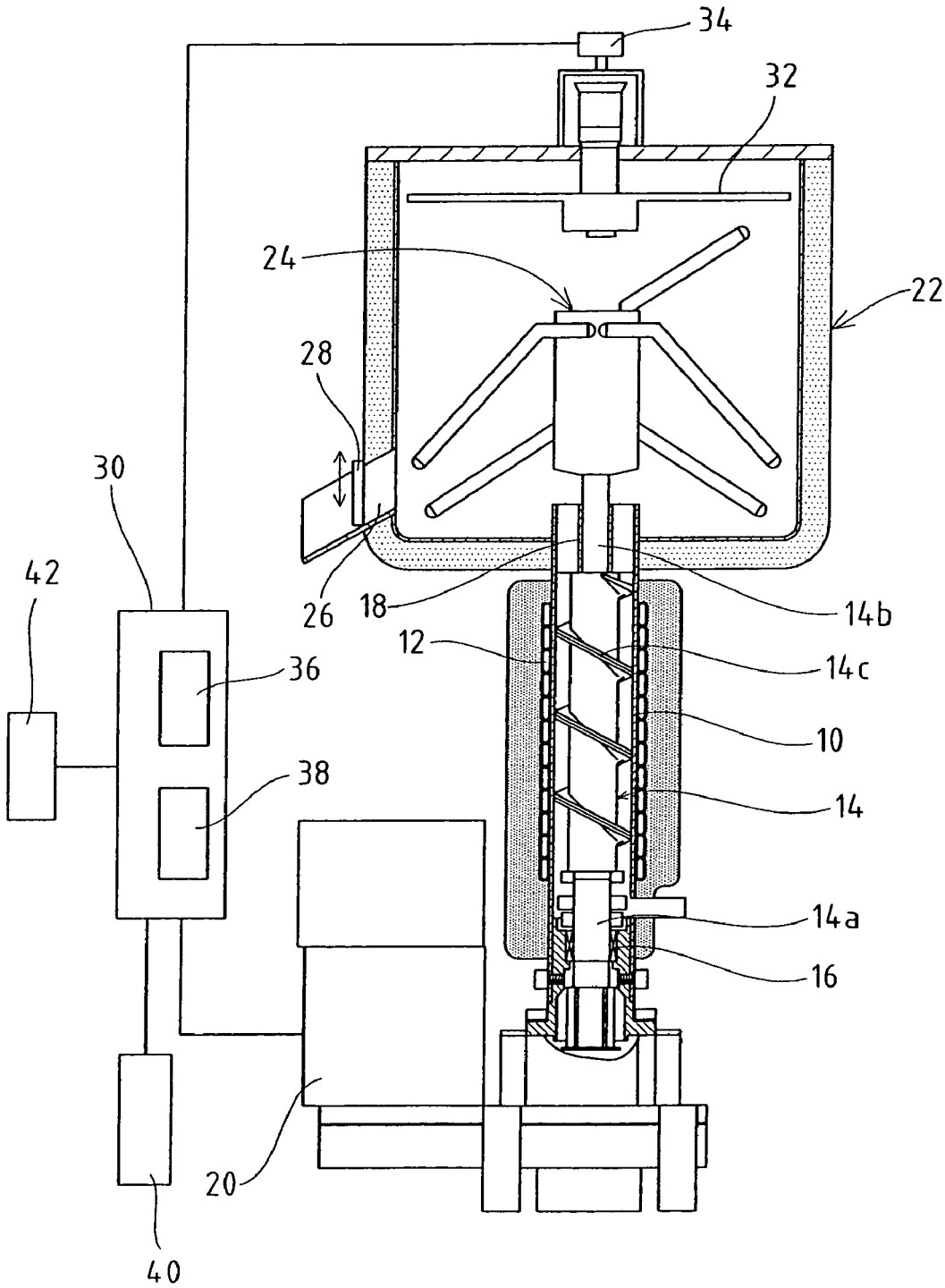
FIG. 6 is a schematic diagram showing an auger ice-making machine to which is applied an operating method according to a third embodiment of the present invention.

FIG. 6 shows a schematic configuration of an auger ice-making machine to which an operating method according to a third embodiment is applied. Since the basic configuration of the machine is the same as adopted in the first and second embodiments described above, only different sections are described below with the same numeral being assigned to the same member.

The controller 30 in the auger ice-making machine according to the third embodiment has a temperature sensor 42 connected for detecting an ambient temperature, a temperature Q detected by the sensor 42 being input to the controller 30. The controller 30 is adapted to calculate a unit quantity of molten ice (per unit time), FA, from the detected temperature Q.

Figure 7:
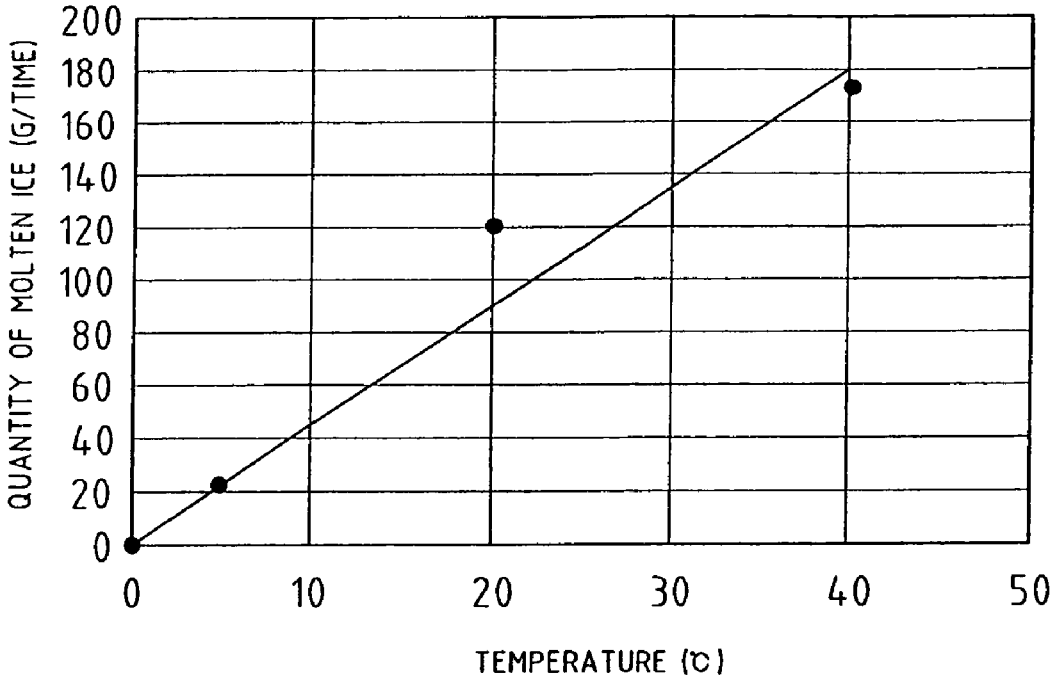
FIG. 7 is a graphic diagram showing the relationship between a unit quantity of molten ice and temperature.

That is, the applicant has experimentally found that as shown in FIG. 7, the unit quantity of molten ice, FA, of the compressed ice in the stocker 22 is proportional to an ambient temperature. The applicant has also verified that the unit quantity of molten ice, FA, at the ambient temperature can be calculated from the product of the constant N (4.47) obtained from the approximated line of FIG. 5, and the detected temperature Q.

In the operating method of the third embodiment, when the stored-ice detector 34 detects high level H, the controller 30 calculates the unit quantity of molten ice, FA, that is the quantity of melting of compressed ice per unit time. That is, the unit quantity of molten ice, FA, commensurate with the current ambient temperature is calculated by multiplying the temperature Q detected by the temperature sensor 42, and the constant N. Subsequently, similarly to the operating method of the second embodiment described above, control is conducted so as to start ice-making operation when actual ice decrement quantity G that is the sum of [(the total quantity of molten ice, B, derived from the unit quantity of molten ice, FA, and an actual time count of T3) and the total quantity of ice discharge, A] exceeds the initial operating quantity of ice, C, previously input to the controller 30. Other control is the same as in the second embodiment.

That is, the operating method of the third embodiment also yields the same operational effects as those of the above-described second embodiment. In addition, in the operating method of the third embodiment, constantly changing temperatures are detected and the unit quantity of molten ice, FA, at each of the temperatures is calculated. Adequate operation control is therefore possible, even in the summertime, for example, when the ambient temperature is high because of air conditioning remaining turned off during off-business hours and the temperature is lowered during business hours by turning air conditioning on.

What is claimed is:

1. A method of operating an auger ice-making machine having:

a refrigeration casing for freezing ice on an inner wall surface of the casing;

an auger screw, rotatably disposed inside the casing, for feeding, while scraping, the ice frozen on the casing inner wall surface;

a stocker for storing/retaining the ice fed by the auger screw; and stored-ice detection means for detecting a high level, and a low level, of a quantity of ice stored within the stocker; wherein ice is discharged to an exterior of said ice-making machine when an ice discharge port formed in the stocker is opened; and said method comprising the ordered steps of:

allowing the control means to judge that a block of ice has occurred in the stocker when a total ice discharge time of the ice discharged from the ice discharge port reaches or exceeds a previously set required time required for discharging a greater quantity of ice than a reference ice storage quantity of the ice stored during a time from detection of the low level to that of the high level, provided that the high level is detected by the stored-ice detection means, and then allowing the ice-making operation to be restated when the control means judges, during a stopped state of the ice-making operation, that a block of ice has occurred in the stocker, provided that the stored-ice detection means has detected the low level.

2. A method of operating an auger ice-making machine having:

a refrigeration casing for freezing ice on an inner wall surface of the casing;

an auger screw, rotatably disposed inside the casing, for feeding, while scraping, the ice frozen on the casing inner wall surface;

a stocker for storing/retaining the ice fed by the auger screw; and stored-ice detection means for detecting a high level, and a low level, of a quantity of ice stored within the stocker, wherein ice is discharged to an exterior of said ice-making machine when an ice discharge port formed in the stocker is opened, and said method comprising the ordered steps of:

allowing control means for monitoring a quantity of discharge from the ice discharge port and a quantity of molten ice within the stocker to be activated to stop ice-making operation when the stored-ice detection means detects the high level; and the allowing the control means to restart the ice-making operation, provided that an actual ice decrement that is a sum of, a total quantity of ice discharge from the ice discharge port and a total quantity of molten ice within the stocker, has exceeded a previously set initial operating quantity of ice.

* * * * *